United States Patent [19]

Moore et al.

[11] 4,374,482

[45] Feb. 22, 1983

[54] VOCAL EFFECT FOR MUSICAL INSTRUMENT

[75] Inventors: Douglas R. Moore, Vernon Hills; Alberto Kniepkamp, Arlington Heights, both of Ill.

[73] Assignee: Norlin Industries, Inc., White Plains, N.Y.

[21] Appl. No.: 219,999

[22] Filed: Dec. 23, 1980

[51] Int. Cl.[3] ..... G10H 1/02

[52] U.S. Cl. ..... 84/1.19; 84/1.24; 84/DIG. 9; 84/1.01

[58] Field of Search ..... 84/1.24, 1.11, 1.19, 84/DIG. 9, 1.01, 1.03

[56] References Cited

U.S. PATENT DOCUMENTS

| | | | |
|---|---|---|---|
| 3,956,960 | 5/1976 | Deutsch | 84/DIG. 9 |
| 4,010,667 | 3/1977 | Kniepkamp | 84/1.03 |
| 4,079,653 | 3/1978 | Finch | 84/1.22 |
| 4,080,861 | 3/1978 | Wholahan | 84/DIG. 9 |
| 4,158,751 | 6/1979 | Bode | 179/1 SA |
| 4,187,397 | 2/1980 | Modena et al. | 179/1 SG |
| 4,192,210 | 3/1980 | Deutsch | 84/1.01 |
| 4,211,138 | 7/1980 | Deutsche | 84/1.19 |
| 4,236,434 | 12/1980 | Nishibe | 84/DIG. 9 |
| 4,300,435 | 11/1981 | Schmoll | 84/1.19 |

*Primary Examiner*—J. V. Truhe
*Assistant Examiner*—Forester W. Isen
*Attorney, Agent, or Firm*—Ronald J. Kransdorf; Jack Kail

[57] ABSTRACT

Apparatus for producing a chorale or vocal effect in an electronic musical instrument comprises means responsive to the playing keys of the instrument for producing an indexing signal and means responsive to the indexing signal for sequentially developing a plurality of control signals. A programmable filter is responsive to each sequentially developed control signal for modifying the harmonic content of a tone signal to simulate a different vowel-like sound for producing a vocal effect consisting of a sequence of different vowel-like sounds as the keys are played. The modified tone signal may be coupled through a chorus generator to simulate a chorale effect and the programmed characteristics of the filter may be modulated to further animate the performance as well as being made responsive to a glide signal for producing two different vowel-like sounds in succession at two different pitches in response to a glissando or portamento command.

19 Claims, 2 Drawing Figures

FIG. 2

| | VOWEL SOUND | GUIDE WORD | F1 (Hz) | F2(Hz) | F3(Hz) |
|---|---|---|---|---|---|
| 0 | LONG E | HEED | 3400 | 2100 | 370 |
| 1 | SHORT O | HAW | 3050 | 1350 | 750 |
| 2 | SHORT A | HAD | 2800 | 1650 | 600 |
| 3 | LONG A | HATE | 2800 | 2100 | 580 |
| 4 | LONG U | HOOT | 2600 | 1050 | 400 |
| 5 | LONG O | HOE | 2500 | 860 | 510 |

VOCAL EFFECT FOR MUSICAL INSTRUMENT

BACKGROUND OF THE INVENTION

The present invention relates generally to electronic musical instruments and, more particularly, to a method and apparatus for operating a keyboard electronic musical instrument, such as an electronic organ, for producing a novel vocal or chorale effect.

Vox or Vox Humana is the name of an effect produced by reed pipes of wind operated pipe organs wherein a human vowel-like sound is produced by a vibrating brass reed suitably coupled to an appropriate resonator. Many attempts have been made in the past to simulate or imitate this effect in a keyboard electronic musical instrument, e.g. an organ, it having been found that simple vowel-like sounds blend well with other organ voices and could be modulated using the same envelope signals normally produced by the instrument. The typical prior art approach to simulating such vowel-like sounds involves the use of multiple formant filters whose filtering characteristics are fixed to modify the harmonic content of an input tone signal in a particular manner. It is also known to simulate the Vox Humana effect by applying a harmonically rich tone signal waveform to a sharp cutoff low-pass filter, the cutoff frequency of the filter being automatically adjustable from a lower frequency when no keys of the organ are played to a higher frequency when a key is played. In yet another prior art electronic organ, the Vox Humana effect is simulated by applying a repeating series of pulse groups separated from each other and each containing a short sequence of two or more pulses to a sharp cutoff low-pass filter.

The Vox Humana effect or vowel-like sounds produced by prior art electronic organs tend to loose their distinctiveness and become monotonous after a time since the identically voiced steady-state tones produced by the fixed formant filters are rapidly interpolated by the ear even though they may be changed in pitch. It is, therefore, a basic object of the present invention to provide an electronic musical instrument capable of generating vowel-like sounds reminicent of the Vox Humana effect, which vowel-like sounds are produced in a manner extremely pleasing to the ear and are closely imitative of a vocal or chorale performance. It is a related object of the invention to provide an electronic keyboard musical instrument capable of generating vowel-like sounds when change in a dynamic manner according to a predetermined sequence.

SUMMARY OF THE INVENTION

In accordance with these and other objects, a novel vocal or chorale effect is achieved in an electronic musical instrument by providing apparatus operable for repetetively producing a sequence of different vowel-like sounds in response to an indexing signal which is preferably, although not necessarily, derived through operation of a keyboard or pedalboard. In a preferred embodiment of the invention, a control device is responsive to a key down or new key down signal for sequentially producing a control signal on a plurality of output conductors. A programmable bandpass filter is responsive to the control signal developed on each different output conductor of the control device for modifying the harmonic content of an input tone signal to produce a different vowel-like sound whereby a pleasing and unmonotonous vocal effect is produced as the keys are played. The modified input tone signal may be coupled to a chorus generator to further enrich the sound and thereby simulate an interesting chorale effect. In another aspect of the invention, the bandpass characteristics of the programmable filter are modulated to yet further animate the performance. In still another aspect of the invention, a glissando or portamento signal is used to modulate the bandpass characteristics of the filter producing two different vowel-like sounds in succession at two different pitches in response to a glide or portamento command.

BRIEF DESCRIPTION OF THE DRAWINGS

The features of the invention which are believed to be novel are set forth with particularity in the appended claims. The invention, together with its objects and the advantages thereof, may be best understood by reference to the following description taken in conjunction with the accompanying drawings in which:

FIG. 2 is a table showing an exemplary manner of programming the bandpass filters of FIG. 1 in accordance with the invention.

DESCRIPTION OF THE PREFERRED EMBODIMENT

Figure 1:
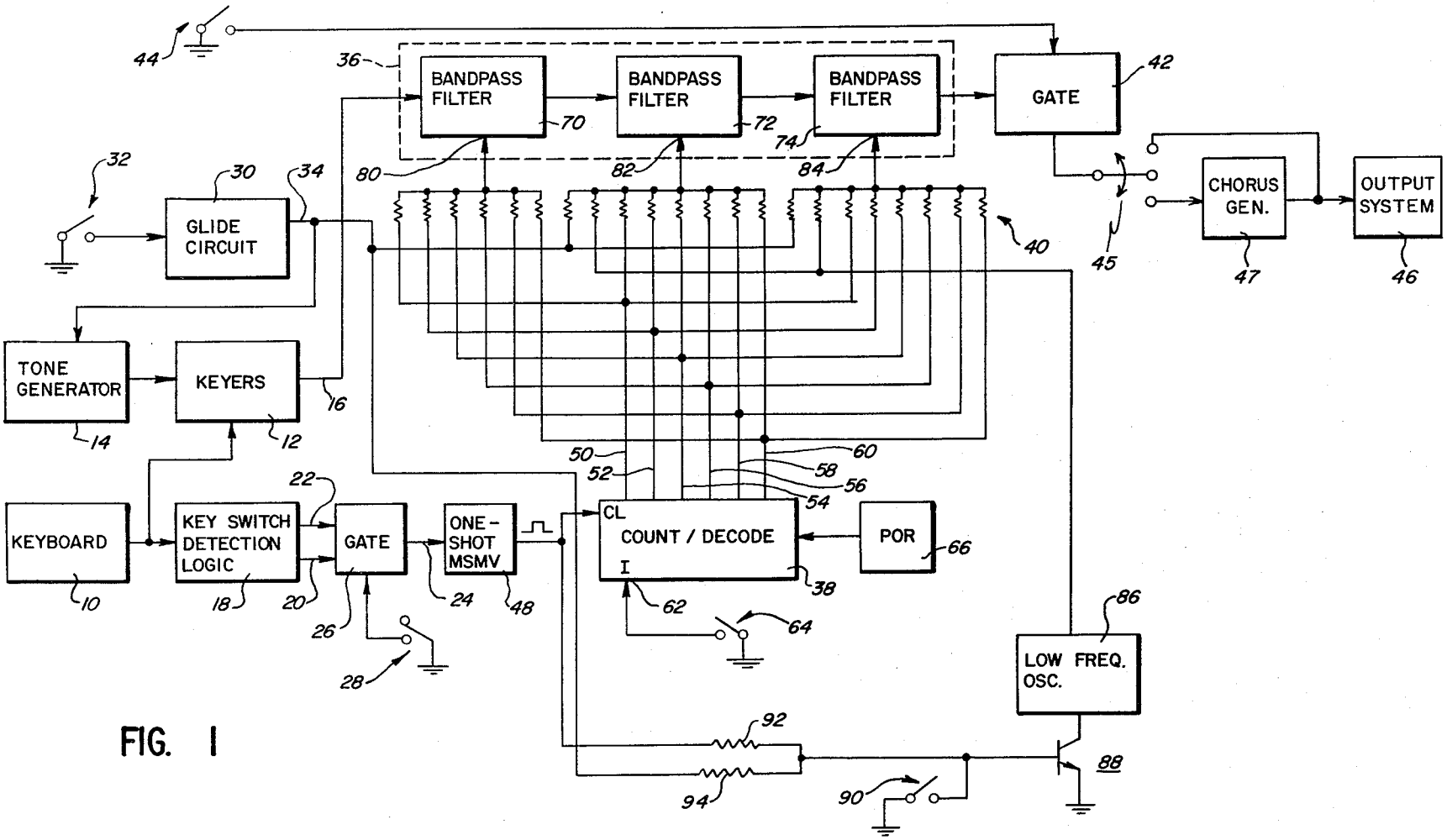
FIG. 1 is a diagram, partly in electrical schematic form and partly in block form, illustrating a preferred embodiment of the invention incorporated for use in a conventional electronic organ.

Referring now to the drawings and, in particular, to FIG. 1, the present invention is shown embodied in a conventional electronic organ including a keyboard 10 which may comprise any or all of an upper manual keyboard, a lower manual keyboard or a pedalboard. Keyboard 10 consists of a plurality of keys each operating a respective key switch, the key switches being typically connected to a plurality of keyers 12 which selectively couple tone signals from a tone generator 14 to an output conductor 16, the frequency of the tone signals developed on conductor 16 being determined by the keys played on keyboard 10. Preferably, the tone signals coupled from tone generator 14 to keyers 12 comprise harmonically rich waveforms such as a sawtooth waveform, a staircase waveform or a waveform consisting of a train of narrow pulses. As is well known in the art, tone generator 14 normally comprises a single master oscillator from which a tone signal having a frequency corresponding to the pitch of each playable key of keyboard 10 may be derived. The organ also includes a conventional key switch detection logic circuit 18 which is responsive to the playing of keyboard 10. In particular, key switch detection logic circuit 18 includes a pair of output conductors 20 and 22 each developing a particular logic signal reflecting the playing status of keyboard 10. A key down logic signal is developed on conductor 20 which is logically low when no keys are being played and which is logically high when one or more keys of keyboard 10 are being played. A new key down logic signal is developed on conductor 22 which transitions from a logically low level to a logically high level whenever a new key is played, i.e. whenever an undepressed key is played. One of the two logic signals developed on conductors 20 and 22 is selectively coupled to the output conductor 24 of a gate 26 in response to the operation of a selector switch 28.

The electronic organ of FIG. 1 further conventionally includes a glide or portamento circuit 30 responsive to a switch 32, which is typically foot operated, for producing a glissando or portamento effect. More specifically, in response to the operation of switch 32, glide circuit 30 generates a glide signal comprising a signal level change to a predetermined amplitude, which signal level change is manifested on an output conductor 34. The glide signal level change developed on conductor 34 is coupled to an input of tone generator 14 whose master oscillator responds thereto by smoothly shifting its operating frequency in accordance with the glide signal. Thus, the operating frequency of the master oscillator and therefore the tone signals generating by tone generator 14, will be smoothly transposed from a first frequency to a second frequency and then back to the first frequency once the signal returns to its initial level creating a glissando or portamento effect. It will be appreciated that the organ circuitry set forth above is entirely conventional and well known in nature and has therefore been described only to the extent necessary to facilitate an understanding of the present invention and its interaction therewith.

In order to produce the novel musical effects contemplated by the invention, the tone signal developed on conductor 16 in response to playing one or more keys on keyboard 10 is processed by a programmable bandpass filter 36 which is controlled by a sequencer 38 through a resistive scaling network 40. Sequencer 38 is responsive to an input indexing signal for indexing through a predetermined sequence of states, each state programming bandpass filter 36 for modifying the harmonic content of the input tone signal to produce a different vowel-like sound. Thus, as sequencer 38 is indexed through its various states, a sequence of distinctly different vowel-like sound signals are developed at the output of filter 36 to simulate a musically pleasing and unmonotonous vocal effect. The vowel-like sound signals developed at the output of filter 36 are selectively coupled through an audio gate 42 in response to the operation of a switch 44 for application by a switch 45 either directly to the output system 46 of the organ, which converts the signals to corredsponding sound waves, or indirectly through a chorus generator 47. Chorus generator 47, which may be of the type taught in U.S. Pat. No. 4,038,898, serves the purpose of enriching the vowel-like sound signals developed at the output of filter 36 to simulate highly pleasing chorale effect.

Although various means can be used to generate the indexing signal operating sequencer 38, e.g., the output of a rhythm pattern generator, a knee lever or footswitch or the playing position on keyboard 10, in the preferred embodiment of the invention illustrated in FIG. 1, the indexing signal is derived from the output of gate 26 which comprises either the key down logic signal or the new key down logic signal. In either event, the output of gate 26 is coupled to a "one-shot" multivibrator 48 which produces an output pulse in response to each logical 0–1 transition of the input signal. The output pulses developed by multivibrator 48 are coupled to the clock input of a six stage counter/decoder which embodies sequencer 38, although various other sequentially operated devices could be used to perform the function of the sequencer. Counter/decoder 38 includes six output conductors 50, 52, 54, 56, 58 and 60 which are sequentially driven to a logic 1 state in response to the input clock pulses. Thus, for example, output conductor 50 may go logically high in response to a first clock pulse with the remaining output conductors 52–60 being logically low, output conductor 52 going logically high in response to a second clock pulse with conductors 50 and 54–60 being logically low and so on, this sequencing pattern being continuously repeated in response to each group of six clock pulses. Counter/decoder 38 also includes an inhibit input 62 responsive to the operation of an inhibit switch 64 for inhibiting any further advance of the sequencing pattern. Thus, when inhibit switch 64 is operated, counter/decoder 38 will be frozen in its current state with one of the output conductors 50–60 being held logically high. A power-on-reset (POR) circuit 66 is provided to set counter/decoder 38 to a desired state upon initial application of power to the organ.

Programmable filter 36 comprises a group of three series connected programmable bandpass filters 70, 72 and 74 each having a respective programming input 80, 82 and 84. Programming input 80 of bandpass filter 70 is connected to each output conductor 50–60 of counter/decoder 38 by a different value scaling resistor of resistive scaling network 40. Similarly, the programming input of bandpass filter 72 is likewise connected to each output conductor 50–60 by a different value scaling resistor of network 40 as is the programming input of bandpass filter 74. Each of the bandpass filters 70, 72 and 74 is programmable for establishing a bandpass frequency response centered at a frequency determined according to the amplitude or level of the signal applied to its respective programming input. Thus, by appropriately selecting the values of the scaling resistors of resistive network 40 a variety of filter characteristics may be established as counter/decoder 38 indexes through its sequence of states. In particular, and in accordance with the invention, the values of the scaling resistors are selected for tailoring the bandpass responses of filters 70, 72 and 74 such that the input tone signal is harmonically modified for producing a different vowel-like sound for each state of counter/decoder 38. The foregoing is illustrated in the Table of FIG. 2 where each of the six sequentially assumable states of counter/decoder 38 is shown in association with a particular vowel-like sound and the center frequencies F1, F2 and F3 of filters 70, 72 and 74 required to form the sound. For example, when counter/decoder 38 is in state 0 with only output conductor 50 logically high, the three scaling resistors connected to conductor 50 are effective for establishing the center frequencies of filters 70, 72 and 74 at 3400, 2100 and 370 Hz respectively enabling the production of a long E vowel-like sound as in the word HEED. In an analogous manner, a short O vowel-like sound as in the word HAW is produced when counter/decoder 38 is indexed to its next sequential state where the scaling resistors connected to output conductor 52 are effective for causing the center frequencies of filters 70, 72 and 74 to assume values of 3050, 1350 and 750 Hz respectively. The remaining vowel-like sounds enumerated in the table are produced in an identical manner as counter/decoder 38 is indexed through its remaining four sequential states.

With reference to the foregoing discussion, consider now operation of the organ of FIG. 1 with switch 28 operated for coupling the key down logic signal developed on conductor 20 through gate 26 to conductor 24. Each time the key down logic signal experiences a logical 0–1 transition, an output clock pulse is developed by multivibrator 48 indexing counter/decoder 38 to its next sequential state wherein a distinct vowel-like sound different from the previous or subsequent vowel-like sound is produced. In this manner, a pleasing and dynamically changing vocal effect is produced as the keys of the organ are played, which vocal effect may be used to initiate a chorale effect by operating switch 45 for connecting chorus generator 47 between gate 42 and output system 46.

Further dynamic change or animation of the vowel-like sounds may be effected by slowly modulating the center frequencies characterizing one or more of the bandpass filters 70, 72 and 74. This is accomplished in the circuit of FIG. 1 by resistively coupling the output of a low frequency oscillator 86 to the programming inputs of bandpass filters 72 and 74, oscillator 86 preferably generating a sinusoidal or triangular waveform signal having a frequency between 0.7 and 1.2 Hz. The operation of oscillator 86 is controlled by a transistor 88 whose base is connected to a switch 90 and through a resistor 92 to the output of multivibrator 48. When switch 90 is closed, the base of transistor 88 is effectively grounded cutting off the transistor and allowing oscillator 86 to continuously run for modulating the center frequencies of filters 72 and 74. However, when the switch is open, transistor 88 is momentarily driven into conduction by each clock pulse produced by multivibrator 48 thereby momentarily interrupting or delaying the operation of the oscillator concurrently with each state change of counter/decoder 38. Delaying the operation of oscillator 86 in this manner has been found to somewhat improve the character of the resulting musical sounds.

The glide or portamento signal developed on output conductor 34 of glide circuit 30 is also resistively coupled to the programming inputs of bandpass filters 72 and 74 and through a resistor 94 to the base of transistor 88. As a consequence, the generation of a glide signal inhibits the operation of oscillator 86 and simultaneously raises the programmed center frequencies of filters 72 and 74 causing them to approach the next adjacent vowel-like sound. This produces an interesting tonal effect wherein two different vowel-like sounds are produced at the output of filter 36 in succession and at two different pitches in response to a glide command.

While a particular embodiment of the present invention has been shown and described, it will be apparent that changes and modifications may be made therein without departing from the invention in its broader aspects. For example, although sequencer 38 has been described above as being embodied in the form of a counter/decoder, other techniques for performing its functions, e.g. the use of a suitably programmed microprocessor, are also contemplated and considered to be within the scope of the invention. The aim of the appended claims, therefore, is to cover all such changes and modifications as fall within the true spirit and scope of the invention.

What is claimed is:

1. In an electronic musical instrument of the type having a keyboard including a plurality of key switches each of which upon depression actuates a means which develops a tone signal whose frequency is determined by the particular operated key switche, the improvement for imparting a vocal effect to said tone signal comprising:

means responsive to the operation of said key switches for producing an indexing signal characterized by a logic transition which occurs for each change in the operational status of said key switches;

control means having a plurality of outputs sequentially actuated in response to successive transitions of said indexing signal; and filter means programmable in response to each of said actuated control means outputs for modifying said tone signal to simultate a different vowel-like sound for producing said vocal effect.

2. The improvement according to claim 1 including an output system adapted for converting tone signals to corresponding sound waves and chorus generator means connected for coupling said modified tone signal to said output system.

3. The improvement according to claim 1 wherein said filter means includes a plurality of programming inputs and further including means coupling each of said control means outputs to each of said filter means programming inputs.

4. The improvement according to claim 3 wherein said filter means comprises a plurality of interconnected programmable bandpass filters each associated with a respective one of said programming inputs, said coupling means comprising scaling means for independently programming the center frequency of each of said bandpass filters to a selected value in response to each of said actuated control means outputs.

5. The improvement according to claim 4 wherein said scaling means comprises a plurality of resistors having selected values for connecting each of said control means outputs to each of said programming inputs.

6. The improvement according to claim 1 wherein said electronic musical instrument includes a key down detector developing a key down signal having a first state when one or more of said key switches are in an operated condition and a second state when none of said keys are in an operated condition, said key down signal comprising said indexing signal and said control means being responsive to each transition from said second state to said first state of said key down signal.

7. The improvement according to claim 1 wherein said electronic musical instrument includes a new key down detector developing a new key down signal transitioning from a second state to a first state each time one of said key switches is operated, said new key down signal comprising said indexing signal and said control means being responsive to each of said transitions of said new key down signal.

8. The improvement according to claim 4 including means for modulating the programmed center frequency of selected ones of said bandpass filters at a relatively low frequency.

9. The improvement according to claim 8 including means for delaying operation of said modulating means at the beginning of the simulation of each of said different vowel-like sounds.

10. The improvement according to claim 1 wherein said electronic musical instrument includes means operable for developing a glide signal representing a selected frequency deviation and means responsive to said glide signal for transposing the frequency of said tone signal through said selected frequency deviation, said filter means being programmable in response to said glide signal for modifying said tone signal to simulate a vowel-like sound different from the vowel-like sound produced in response to the current one of said output signals as said tone signal is transposed through said frequency deviation.

11. In an electronic musical instrument of the type having a keyboard comprising a plurality of key switches each of which upon depression actuates a means which develops a tone signal whose frequency is determined by the particular operated one of said key switches, the improvement comprising:

means responsive to the operation of said key switches for developing an indexing signal characterized by a logic transition which occurs for each change in the operational status of said keyswitches;

control means having a plurality of outputs sequentially actuated in response to successive logic transitions of said indexing signal; and filter means comprising a plurality of series connected programmable bandpass filters each having a programmable input and scaling means coupling each of said control means ouptuts to each of said programming inputs for independently programming the center frequency of each of said bandpass filters for modifying the harmonic content of said tone signal to simulate a different vowel-like sound in response to each of said actuated control means outputs.

12. The improvement according to claim 11, including means for imparting a chorus effect to said modified tone signal.

13. The improvement according to claim 11 wherein said scaling means comprises a plurality of scaling resistors each having a selected resistance.

14. In an electronic musical instrument of the type including means for developing a tone signal, the improvement comprising:

means for producing an indexing signal having first and second states and transitions therebetween;

control means having a plurality of outputs and being responsive to the transitions of said indexing signal for sequentially developing a control signal on said plurality of outputs;

a plurality of interconnected programmable bandpass filter means each having a programming input; and scaling means coupling each of said control means outputs to the programming input of each of said bandpass filter means for independently programming the center frequency of each of said bandpass filter means in response to each of said control signals for modifying the harmonic content of said tone signal to simulate a differently voiced sound.

15. In an electronic musical instrument of the type including means for developing a tone signal, the improvement for imparting a vocal effect to said tone signal comprising:

means for producing an indexing signal having first and second states and transitions therebetween;

control means having a plurality of outputs and being responsive to the transitions of said indexing signal for sequentially developing a control signal on said plurality of outputs;

a plurality of interconnected programmable bandpass filter means each having a programming input; and scaling means coupling each of said control means outputs to the programming input of each of said bandpass filter means for independently programming the center frequency of each of said bandpass filter means in response to each of said control signals for modifying the harmonic content of said tone signal to simulate a different vowel-like sound for producing said vocal effect.

16. The improvement according to claim 15 including means for imparting a chorus effect to said modified tone signal.

17. The improvement according to claim 15 wherein said scaling means comprises a plurality of scaling resistors each coupling one of said control means outputs to the programming input of a respective one of each of said bandpass filter means.

18. The improvement according to claim 15 including means slowly modulating the programmed center frequency of at least some of said bandpass filter means for animating said vowel-like sound.

19. The improvement according to claim 18 including means for delaying the operation of said modulating means at the beginning of the simulation of each of said vowel-like sound.

* * * * *